US010023419B1

(12) United States Patent
Taki

(10) Patent No.: US 10,023,419 B1
(45) Date of Patent: Jul. 17, 2018

(54) SHEET PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/711,033

(22) Filed: Sep. 21, 2017

(51) Int. Cl.

| | |
|---|---|
| ***B65H 31/34*** | (2006.01) |
| ***B65H 31/38*** | (2006.01) |
| ***B65H 31/02*** | (2006.01) |
| ***B65H 9/04*** | (2006.01) |
| ***B65H 9/06*** | (2006.01) |
| ***B65H 31/28*** | (2006.01) |
| ***B65H 9/10*** | (2006.01) |

(52) U.S. Cl.
CPC ..... *B65H 31/34* (2013.01); *B65H 9/04* (2013.01); *B65H 9/06* (2013.01); *B65H 9/10* (2013.01); *B65H 9/101* (2013.01); *B65H 31/02* (2013.01); *B65H 31/28* (2013.01); *B65H 31/38* (2013.01); *B65H 2301/36* (2013.01); *B65H 2301/363* (2013.01); *B65H 2408/114* (2013.01); *B65H 2408/1144* (2013.01)

(58) Field of Classification Search
CPC ... B65H 9/04; B65H 9/06; B65H 9/10; B65H 9/101; B65H 31/02; B65H 31/28; B65H 31/34; B65H 31/38; B65H 2301/36; B65H 2301/363; B65H 2408/114; B65H 2408/1144
USPC ..... 270/58.12, 58.17, 58.27
See application file for complete search history.

(56) References Cited

U.S. PATENT DOCUMENTS

| | | | | |
|---|---|---|---|---|
| 6,290,220 | B1 * | 9/2001 | Takehara | B42C 1/12 270/58.08 |
| 7,784,778 | B2 * | 8/2010 | Shimizu | B65H 31/36 270/58.07 |
| 8,087,654 | B2 * | 1/2012 | Awano | B65H 31/20 270/58.07 |

(Continued)

FOREIGN PATENT DOCUMENTS

| | | |
|---|---|---|
| JP | 5239823 | 4/2013 |

*Primary Examiner* — Leslie A Nicholson, III
(74) *Attorney, Agent, or Firm* — Amin, Turocy & Watson LLP

(57) ABSTRACT

In accordance with an embodiment, a sheet processing apparatus comprises a processing tray, a longitudinal alignment mechanism, a horizontal alignment mechanism and an interlocking mechanism. The processing tray can stack a sheet. The longitudinal alignment mechanism includes a rotatable paddle. The longitudinal alignment mechanism can align the sheets stacked on the processing tray in a sheet conveyance direction. The horizontal alignment mechanism includes a horizontal alignment plate movable in a sheet width direction orthogonal to the sheet conveyance direction. The horizontal alignment mechanism can align the sheets placed on the processing tray in the sheet width direction. The interlocking mechanism interlocks the paddle in the sheet width direction in synchronization with the movement of the horizontal alignment plate in the sheet width direction.

10 Claims, 10 Drawing Sheets

(56) References Cited

U.S. PATENT DOCUMENTS

| | | | | |
|---|---|---|---|---|
| 8,136,810 | B1 * | 3/2012 | Wang | B65H 31/3081 270/58.12 |
| 8,720,880 | B2 * | 5/2014 | Awano | B65H 31/36 270/58.07 |
| 2017/0183188 | A1 | 6/2017 | Taki | |

* cited by examiner

SHEET PROCESSING APPARATUS

FIELD

Embodiments described herein relate generally to a sheet processing apparatus.

BACKGROUND

Conventionally, there is a sheet processing apparatus for executing a post-processing on a sheet conveyed from an image forming apparatus. The sheet processing apparatus includes a processing tray, a longitudinal alignment mechanism and a horizontal alignment mechanism. The processing tray is used in the post-processing of the sheet. The longitudinal alignment mechanism has a rotatable paddle. The longitudinal alignment mechanism can align the sheets placed on the processing tray in a sheet conveyance direction. The horizontal alignment mechanism has a horizontal alignment plate movable in a sheet width direction orthogonal to the sheet conveyance direction. The horizontal alignment mechanism can align the sheets placed on the processing tray in the sheet width direction. However, if the sheet is moved by the horizontal alignment mechanism in the sheet width direction, or depending on a sheet size, a position or number of paddles contacting with the sheet changes. If the position or the number of paddles contacting with the sheet changes, a force (hereinafter also referred to as a "longitudinal alignment force") for striking the sheet of the paddle changes. If the longitudinal alignment force changes, there is a possibility that the sheet skews and misalignment occurs.

BRIEF DESCRIPTION OF THE DRAWINGS

FIG. 9 is a view of an alignment operation of a sheet a;

DETAILED DESCRIPTION

Figure 1:
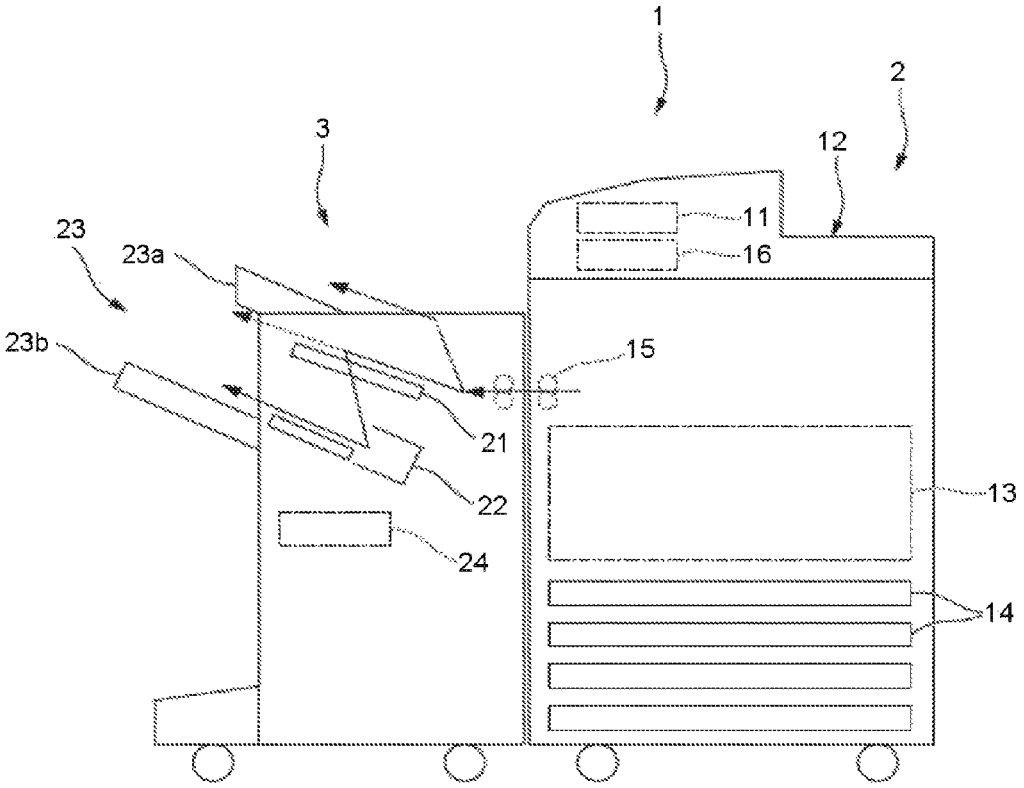
FIG. 1 is a front view of an image forming system.

In accordance with an embodiment, a sheet processing apparatus comprises a processing tray, a longitudinal alignment mechanism, a horizontal alignment mechanism and an interlocking mechanism. The processing tray can stack a sheet. The longitudinal alignment mechanism includes a rotatable paddle. The longitudinal alignment mechanism can align the sheets stacked on the processing tray in a sheet conveyance direction. The horizontal alignment mechanism includes a horizontal alignment plate movable in a sheet width direction orthogonal to the sheet conveyance direction. The horizontal alignment mechanism can align the sheets placed on the processing tray in the sheet width direction. The interlocking mechanism interlocks the paddle in the sheet width direction in synchronization with the movement of the horizontal alignment plate in the sheet width direction.

Hereinafter, a sheet processing apparatus of an embodiment is described with reference to the accompanying drawings. In each figure, components having the same or similar function are donated with the same reference numeral.

FIG. 1 is a front view illustrating an example of an image forming system 1 according to the embodiment. As shown in FIG. 1, the image forming system 1 includes an image forming apparatus 2 and a post-processing apparatus 3. The image forming apparatus 2 forms an image on a sheet-like medium (hereinafter, referred to as a "sheet") such as a paper. The post-processing apparatus 3 executes a post-processing on the sheet conveyed from the image forming apparatus 2. The post-processing apparatus 3 is an example of a "sheet processing apparatus".

The image forming apparatus 2 includes a control panel 11, a scanner section 12, a printer section 13, a sheet feed section 14, a sheet discharge section 15 and an image forming controller 16.

The control panel 11 is provided with various keys for receiving operations by a user. For example, the control panel 11 receives an input relating to a type of a post-processing carried out on the sheet. The control panel 11 sends information relating to the type of the input post-processing to the post-processing apparatus 3.

The scanner section 12 includes a reading section for reading image information to be copied. The scanner section 12 sends the read image information to the printer section 13.

The printer section 13 forms an output image (hereinafter, referred to as a "toner image") by a developer such as a toner according to the image information sent from the scanner section 12 or an external device. The printer section 13 transfers the toner image onto the surface of the sheet. The printer section 13 applies heat and pressure to the toner image transferred onto the sheet to fix the toner image on the sheet.

The sheet feed section 14 supplies sheets one by one to the printer section 13 in accordance with a timing at which the printer section 13 forms the toner image.

The sheet discharge section 15 conveys the sheet discharged from the printer section 13 to the post-processing apparatus 3.

The image forming controller 16 controls the whole operation of the image forming apparatus 2. The image forming controller 16 controls the control panel 11, the scanner section 12, the printer section 13, the sheet feed section 14 and the sheet discharge section 15. The image forming controller 16 is formed by a control circuit including a CPU, a ROM, and a RAM.

Next, the post-processing apparatus 3 is described.

The post-processing apparatus 3 is arranged adjacently to the image forming apparatus 2. The post-processing apparatus 3 executes the post-processing designated through the control panel 11 on the sheet conveyed from the image forming apparatus 2. For example, the post-processing is a sorting processing or a stapling processing.

Figure 2:
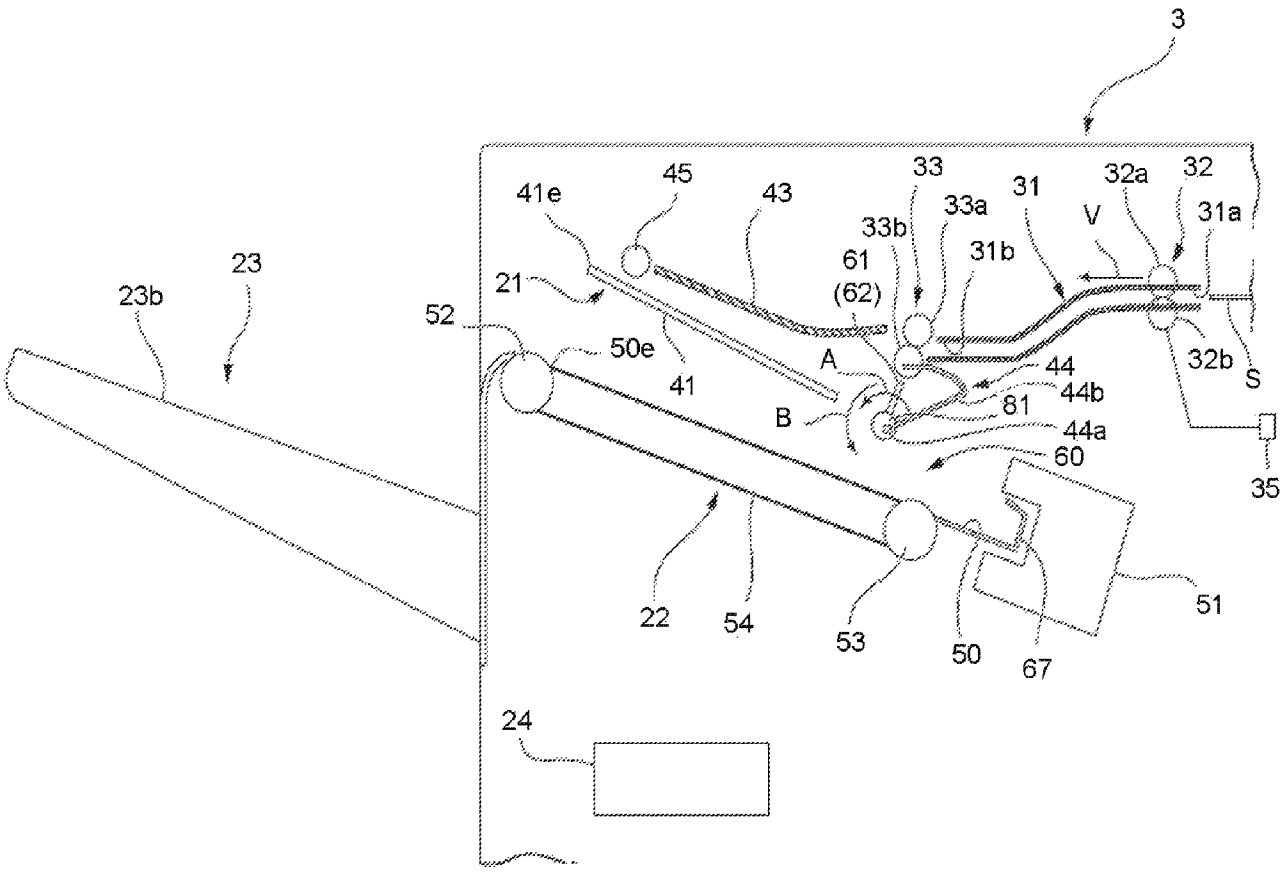
FIG. 2 is a diagram of a cross section view of a post-processing apparatus.

FIG. 2 is a diagram containing a cross section illustrating the main portions of the post-processing apparatus 3 according to the embodiment. As shown in FIG. 2, a conveyance path 31 is arranged in the post-processing apparatus 3. The post-processing apparatus 3 includes an entrance side conveyance section 32, an exit side conveyance section 33, a standby section 21, a processing section 22, a discharge section 23 and a post-processing controller 24.

First, the conveyance path 31 is described.

The conveyance path 31 is provided with a sheet supply port 31*a* and a sheet discharge port 31*b*.

The sheet supply port 31*a* faces the image forming apparatus 2 (refer to FIG. 1). The sheet supply port 31*a* is supplied with the sheet S from the image forming apparatus 2.

On the other hand, the sheet discharge port 31*b* is positioned nearby the standby section 21. The sheet S passing through the conveyance path 31 is discharged from the sheet discharge port 31*b* to the standby section 21 or the discharge section 23.

The entrance side conveyance section 32 is described.

The entrance side conveyance section 32 includes a pair of entrance rollers 32*a* and 32*b* and a sheet conveyance motor 35. The entrance rollers 32*a* and 32*b* are arranged close to the sheet supply port 31*a*. The entrance rollers 32*a* and 32*b* are driven by the sheet conveyance motor 35. The entrance rollers 32*a* and 32*b* convey the sheet S supplied to the sheet supply port 31*a* toward the downstream side of the conveyance path 31. For example, the entrance rollers 32*a* and 32*b* convey the sheet S supplied to the sheet supply port 31*a* to the exit side conveyance section 33.

The exit side conveyance section 33 is described.

The exit side conveyance section 33 includes a pair of exit rollers 33*a* and 33*b*. The exit rollers 33*a* and 33*b* are arranged close to the sheet discharge port 31*b*. The exit rollers 33*a* and 33*b* receive the sheet S conveyed by the entrance rollers 32*a* and 32*b*. The exit rollers 33*a* and 33*b* can convey the sheet S from the sheet discharge port 31*b* to the standby section 21 or the discharge section 23.

In the embodiment, the sheet S is conveyed from the image forming apparatus 2 to the discharge section 23. Hereinafter, in a conveyance direction V of the sheet S (hereinafter, referred to as a "sheet conveyance direction V"), the image forming apparatus 2 side is referred to as an "upstream side". In the sheet conveyance direction V, the discharge section 23 side is referred to as a downstream side.

The standby section 21 is described.

The standby section 21 temporarily retains (buffers) the sheet S conveyed from the exit side conveyance section 33. For example, a plurality of succeeding sheets S stands by on the standby section 21 while the post-processing is executed on the former sheet S by the processing section 22. The standby section 21 is arranged above the processing section 22. If the processing section 22 is idle, the standby section 21 drops the sheet S being buffered towards the processing section 22.

Specifically, the standby section 21 includes a standby tray 41, an opening and closing drive section 42 (refer to FIG. 3), an assist guide 43, a chuck section 44 and conveyance rollers 45.

An upstream end of the standby tray 41 is positioned close to the exit roller 33*b*. The upstream end of the standby tray 41 is positioned below the sheet discharge port 31*b* of the conveyance path 31. The standby tray 41 is tilted with respect to the horizontal direction so as to be positioned upward at the downstream side of the sheet conveyance direction V. A plurality of the sheets S is stacked in a standby state on the standby tray 41 while the post-processing is executed in the processing section 22.

Figure 3:
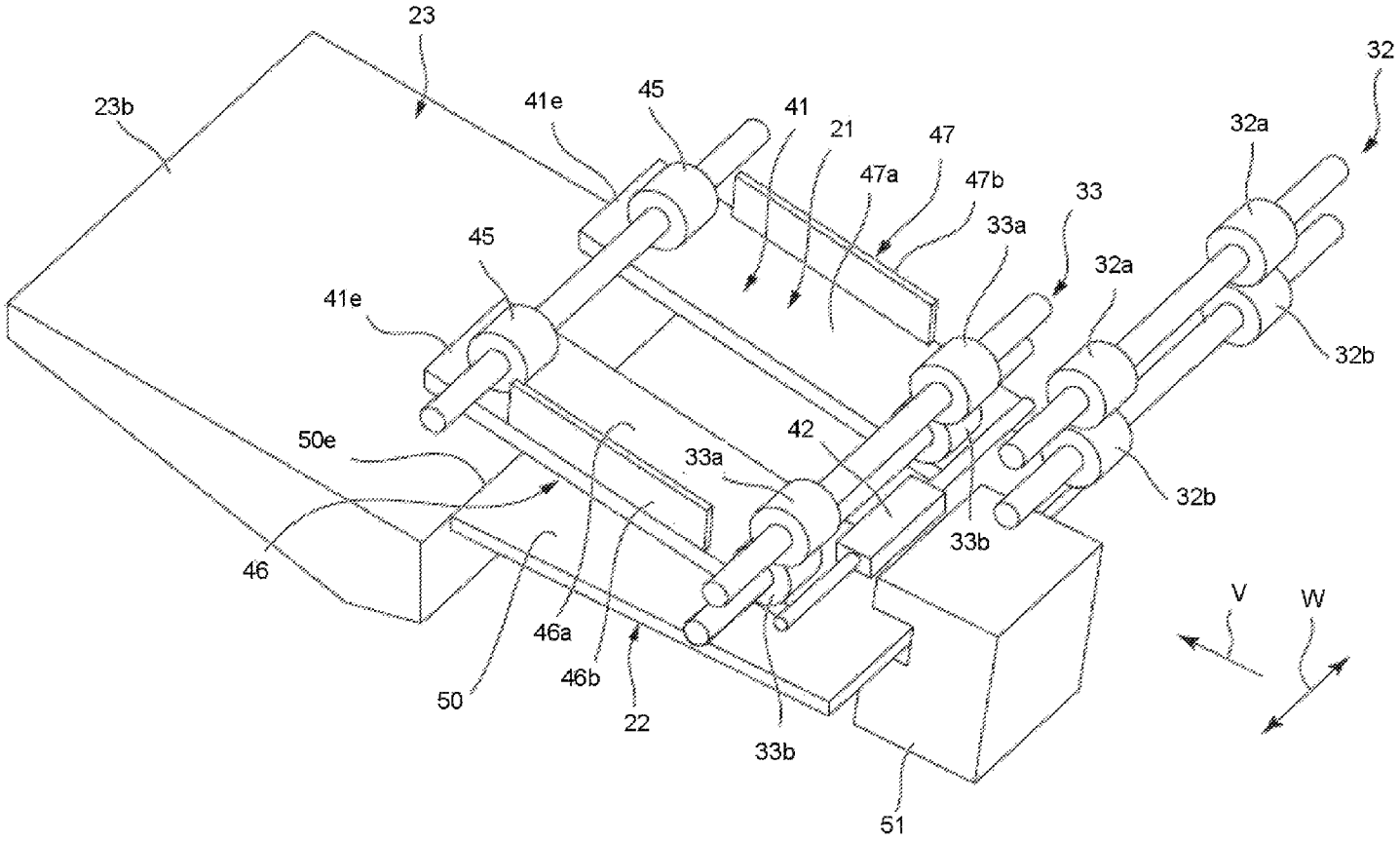
FIG. 3 is a perspective view of the post-processing apparatus.

FIG. 3 is a perspective view illustrating the main portions of the post-processing apparatus 3 according to the embodiment. As shown in FIG. 3, the standby tray 41 includes a first support member 46 and a second support member 47.

The first support member 46 and the second support member 47 are spaced apart from each other in a direction intersecting the sheet conveyance direction V. Hereinafter, a width direction W of the sheet S is referred to as a "sheet width direction W". In the embodiment, the first support member 46 and the second support member 47 are substantially parallel to the horizontal direction and spaced apart from each other in the sheet width direction W that is substantially orthogonal to the sheet conveyance direction V. The first support member 46 and the second support member 47 are movable in a direction close to each other and a direction away from each other in the sheet width direction W.

The first support member 46 and the second support member 47 respectively have bottom walls 46*a* and 47*a* and side walls 46*b* and 47*b*. Each of the bottom walls 46*a* and 47*a* has a plate shape having a length in the sheet conveyance direction V. The bottom walls 46*a* and 47*a* can support the sheet S from below. The side walls 46*b* and 47*b* stand upward from outer edges in the sheet width direction W of the bottom walls 46*a* and 47*a*. The side walls 46*b* and 47*b* can support the sides in the sheet width direction W of the sheet S.

The opening and closing drive section 42 is capable of driving the first support member 46 and the second support member 47 in a direction close to each other or in a direction away from each other.

The opening and closing drive section 42 enables the first support member 46 and the second support member 47 to be close to each other if the sheet S stands by on the standby tray 41. In this way, the sheet S is supported by the first support member 46 and the second support member 47.

On the other hand, the opening and closing drive section 42 enables the first support member 46 and the second support member 47 to separate from each other if the sheet S moves from the standby tray 41 to a processing tray 50 of the processing section 22. As a result, the sheet S supported by the standby tray 41 falls from a gap between the first support member 46 and the second support member 47 towards the processing tray 50. As a result, the sheet S moves from the standby tray 41 to the processing tray 50.

As shown in FIG. 2, the assist guide 43 is positioned above the standby tray 41. The assist guide 43 is a plate-shaped member extending above the standby tray 41. An upstream end of the assist guide 43 is positioned close to the exit roller 33*a*. The upstream end of the assist guide 43 is positioned slightly above the sheet discharge port 31*b* of the conveyance path 31. The assist guide 43 bends gently to be positioned at the lower side at the downstream side of the sheet conveyance direction V and then bends and extends so as to be positioned at the upper side at the downstream side of the sheet conveyance direction V.

In the gap between the assist guide 43 and the standby tray 41, the sheet S discharged from the exit rollers 33*a* and 33*b* enters. The sheet S entering the standby section 21 is guided by the assist guide 43 and the standby tray 41 to advance towards the back of the standby section 21.

The chuck section 44 is arranged at the upstream side of the standby tray 41 in the sheet conveyance direction V. The chuck section 44 can maintain the height of the uppermost surface of the sheet S conveyed to the standby tray 41 at a constant height. The chuck section 44 pushes the upstream end of the sheet S conveyed to the standby tray 41 toward the standby tray 41 by rotation of the chuck section 44.

Specifically, the chuck section 44 includes a rotation axis 44*a* and an arm portion 44*b*.

The rotation axis 44*a* is positioned at the upstream side of the standby tray 41 in the sheet conveyance direction V. The rotation axis 44*a* is positioned below the standby tray 41. The rotation axis 44*a* has a length in the sheet width direction W. The chuck section 44 is rotatable in an arrow A direction around the rotation axis 44*a*. An L-shaped arm portion 44*b* is attached to the rotation axis 44*a*.

For example, the chuck section 44 presses the upstream end of the sheet S towards the standby tray 41 by being rotated according to a timing at which the sheet S is discharged from the exit rollers 33*a* and 33*b* towards the standby tray 41. In this way, the upstream end of the sheet S can be suppressed from floating on the standby tray 41.

The conveyance rollers 45 are arranged close to a downstream end 41*e* of the standby tray 41. As shown in FIG. 3, the conveyance rollers 45 are movable in a direction close to the bottom walls 46*a* and 47*a* of the standby tray 41 and in a direction away from the bottom walls 46*a* and 47*a* of the standby tray 41. The conveyance rollers 45 can move the sheet S to a fixed position on the bottom walls 46*a* and 47*a* of the standby tray 41 if the sheet S stands by on the standby tray 41.

The processing section 22 is described.

The processing section 22 carries out the post-processing on the conveyed sheet S. For example, the processing section 22 aligns a plurality of sheets S. The processing section 22 carries out a stapling processing on a plurality of aligned sheets S. As a result, a plurality of the sheets S is bound together. The processing section 22 discharges the sheet S on which the post-processing is carried out to the discharge section 23.

As shown in FIG. 2, the processing section 22 includes the processing tray 50, a stapler 51, driving rollers 52 and 53 and a conveyance belt 54.

As shown in FIG. 3, the processing tray 50 is positioned below the standby tray 41. The processing tray 50 can stack the sheet S. The processing tray 50 is tilted with respect to the horizontal direction so as to be positioned at the upper side at the downstream side of the sheet conveyance direction V. In the embodiment, the processing tray 50 is tilted somewhat more gently than the standby tray 41 in the horizontal direction. In the sheet conveyance direction V, a downstream end 50*e* of the processing tray 50 is positioned at the downstream side of the downstream end 41*e* of the standby tray 41. The plurality of sheets S moving to the processing tray 50 is aligned in the sheet width direction W and the sheet conveyance direction V by a longitudinal alignment mechanism 60 and a horizontal alignment mechanism 70 (refer to FIG. 4).

The stapler 51 is provided at the end of the processing tray 50. The stapler 51 staples (binds) a bundle composed of a predetermined number of the sheets S positioned on the processing tray 50.

As shown in FIG. 2, the driving rollers 52 and 53 are arranged at a predetermined interval in the sheet conveyance direction V. The conveyance belt 54 is stretched over the driving rollers 52 and 53. As viewed from the sheet width direction W, the downstream end of the conveyance belt 54 overlaps with the downstream end 50*e* of the processing tray 50. The conveyance belt 54 is rotated synchronously with the driving rollers 52 and 53. The conveyance belt 54 can convey the sheet S between the stapler 51 and the movable tray 23*b*.

Figure 4:
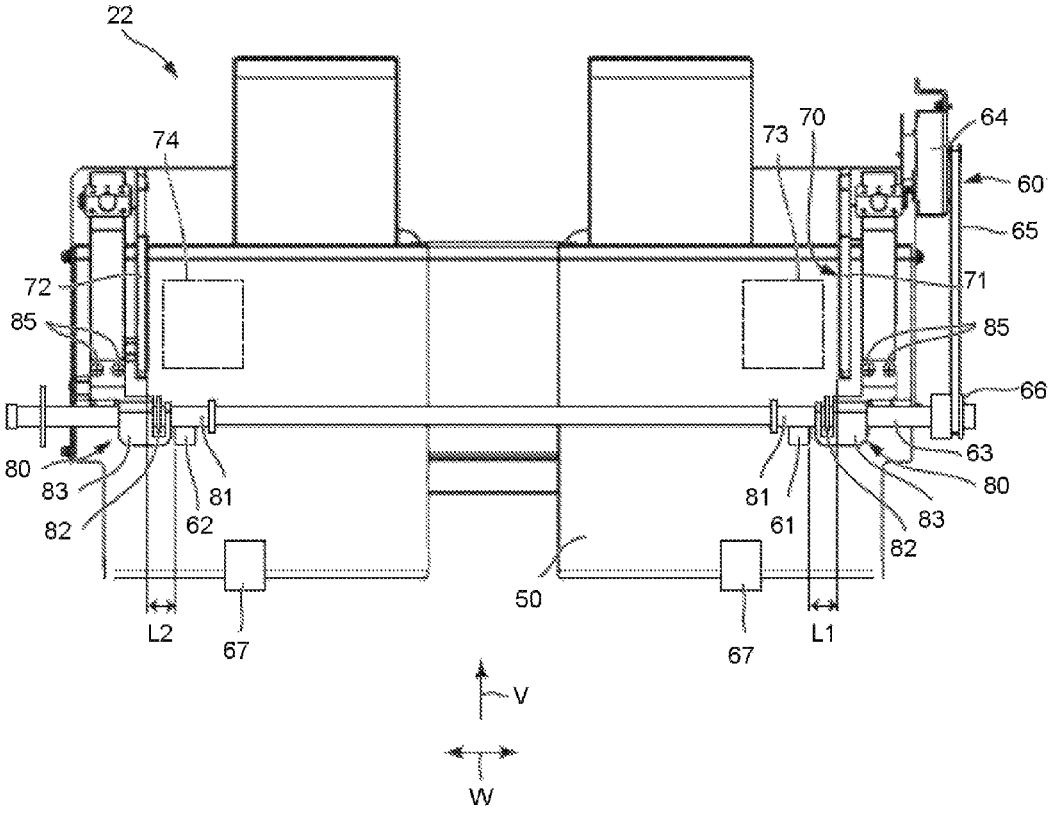
FIG. 4 is a plan view of a processing section.
Figure 5:
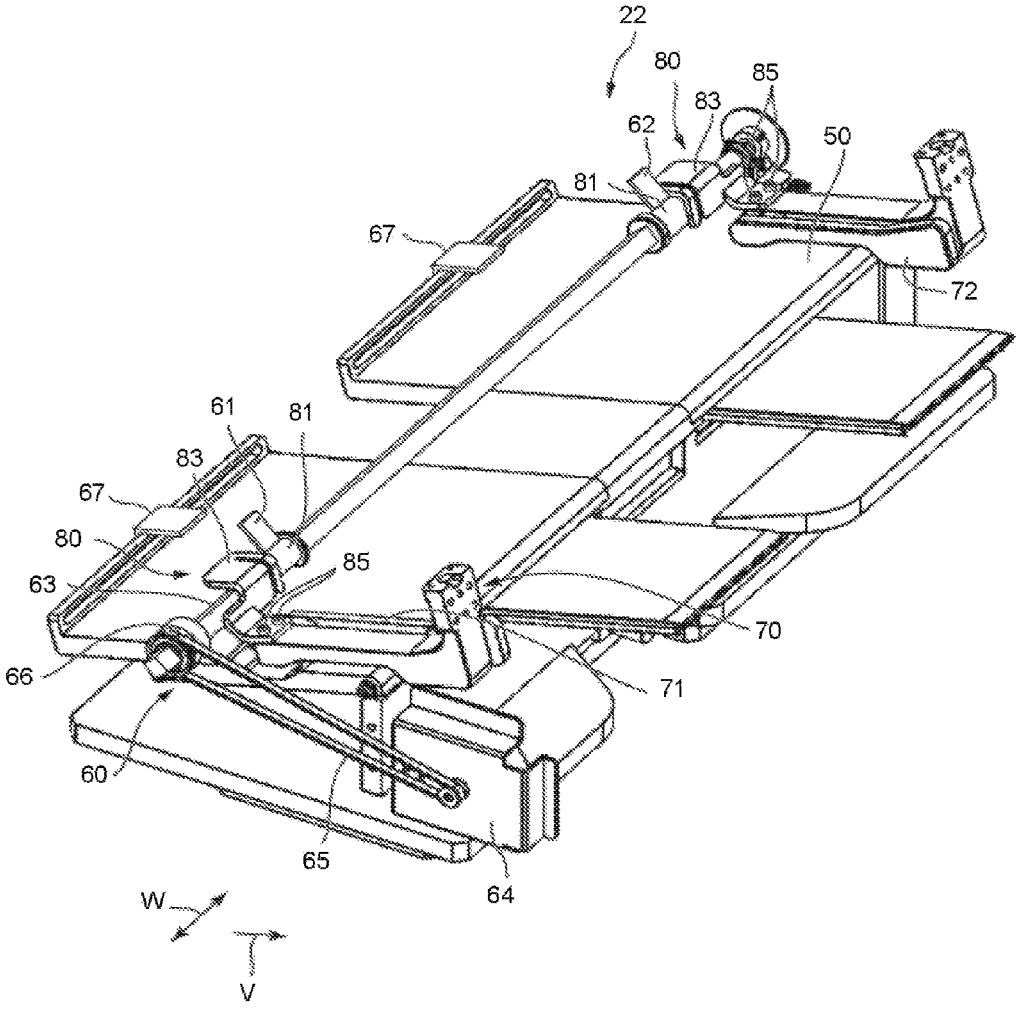
FIG. 5 is a perspective view of the processing section.

FIG. 4 is a plan view of the processing section 22 according to the embodiment. FIG. 5 is a perspective view of the processing section 22 according to the embodiment. In FIG. 4 and FIG. 5, the illustration of the stapler 51, the driving rollers 52 and 53 and the conveyance belt 54 is omitted.

As shown at FIG. 4, the processing section 22 includes the processing tray 50, the longitudinal alignment mechanism 60, the horizontal alignment mechanism 70 and an interlocking mechanism 80.

First, the longitudinal alignment mechanism 60 is described.

The longitudinal alignment mechanism 60 includes a rotatable paddle 61. The longitudinal alignment mechanism 60 can align the sheet S placed on the processing tray 50 in the sheet conveyance direction V. As shown in FIG. 2, the paddle 61 is placed between the standby tray 41 and the processing tray 50. The paddle 61 is positioned at the upstream side of the standby tray 41 and above the processing tray 50. The paddle 61 moves the sheet S dropping on the processing tray 50 toward the stapler 51. The paddle 61 is rotatable in an arrow B direction around a shaft 63 (refer to FIG. 4).

For example, the paddle 61 is formed by an elastic material such as rubber. The paddle 61 protrudes from an outer peripheral surface of a collar 81 toward a radially outer side of the collar 81. For example, the paddle 61 contacts with the upper surface of the sheet S positioned at the uppermost position among a plurality of sheets S falling onto the processing tray 50 by being rotated. The paddle 61 is further rotated in contact with the upper surface of the sheet S, thereby moving the sheet S toward the stapler 51.

As shown in FIG. 4, the longitudinal alignment mechanism 60 includes a plurality of paddles 61 and 62. In the embodiment, the longitudinal alignment mechanism 60 includes two paddles 61 and 62. The two paddles 61 and 62 are a first paddle 61 and a second paddle 62 arranged at intervals in the sheet width direction W. The first paddle 61 is positioned at a second alignment plate side by a first distance L1 from a first horizontal alignment plate 71. Here, the first distance L1 is a distance between the inner surface of the first horizontal alignment plate 71 and an outer end of the first paddle 61 in the sheet width direction W. The second paddle 62 is positioned at the first horizontal alignment plate 71 side by a second distance L2 as long as the first distance L1 from a second horizontal alignment plate 72. Here, the second distance L2 is a distance between the inner surface of the second horizontal alignment plate 72 and the outer end of the second paddle 62 in the sheet width direction W. In the embodiment, the first distance L1 and the second distance L2 are the same distance (L1=L2).

The first paddle 61 and the second paddle 62 have the same shape. The first paddle 61 and the second paddle 62 mutually have the same elastic force. In other words, the first paddle 61 and the second paddle 62 have the same Young's modulus. For example, the first paddle 61 and the second paddle 62 are formed of the same elastic material.

As shown in FIG. 5, the longitudinal alignment mechanism 60 further includes a shaft 63, a driving motor 64 and a belt 65. The shaft 63 extends in the sheet width direction W. The axial direction of the shaft 63 is parallel in the sheet width direction W. The driving motor 64 generates a driving power to rotate the paddles 61 and 62 about the shaft 63. In the embodiment, the driving motor 64 is a common driving motor that generates the driving power to rotate the first paddle 61 and the second paddle 62. The longitudinal alignment mechanism 60 has only one driving motor 64.

The belt 65 is stretched over a shank of the driving motor 64 and the shaft 63. A pulley 66 on which the belt 65 is hung is attached to an end of the shaft 63. The rotational power of the shank of the driving motor 64 is transmitted to the paddles 61 and 62 via the belt 65, the pulley 66, the shaft 63 and the collar 81. The collar 81 is included in the components of the longitudinal alignment mechanism 60.

At the upstream end of the processing tray 50, a pair of stoppers 67 is provided. The pair of stoppers 67 is arranged at intervals in the sheet width direction W. Due to the rotation of the paddles 61 and 62, the sheet S placed on the processing tray 50 is conveyed toward the stopper 67. The longitudinal alignment mechanism 60 performs the alignment (so-called longitudinal alignment) of the sheet S in the sheet conveyance direction V by enabling the sheet S to contact with the stopper 67.

Next, the horizontal alignment mechanism 70 is described.

The horizontal alignment mechanism 70 includes the horizontal alignment plate 71 movable in the sheet width direction W. The horizontal alignment mechanism 70 can align the sheet S placed on the processing tray 50 in the sheet width direction W. The horizontal alignment mechanism 70 includes a plurality of the horizontal alignment plates 71 and 72. In the embodiment, the horizontal alignment mechanism 70 includes two horizontal alignment plates 71 and 72. The two horizontal alignment plates 71 and 72 are the first horizontal alignment plate 71 and the second horizontal alignment plate 72 separated from each other in the sheet width direction W.

As shown in FIG. 4, the horizontal alignment mechanism 70 includes a first horizontal alignment motor 73 and a second horizontal alignment motor 74. The first horizontal alignment plate 71 and the second horizontal alignment plate 72 are driven by the first horizontal alignment motor 73 and the second horizontal alignment motor 74, respectively. The first horizontal alignment motor 73 is the driving motor for the first horizontal alignment plate 71. The second horizontal alignment motor 74 is the driving motor for the second horizontal alignment plate 72. By driving the first horizontal alignment motor 73 and the second horizontal alignment motor 74, the first horizontal alignment plate 71 and the second horizontal alignment plate 72 are movable in a direction close to each other and a direction away from each other in the sheet width direction W. Due to the approach and separation of the first horizontal alignment plate 71 and the second horizontal alignment plate 72, the horizontal alignment mechanism 70 performs alignment of the sheet (the so-called horizontal alignment) in the sheet width direction W.

Next, the interlocking mechanism 80 is described.

The interlocking mechanism 80 interlocks the paddles 61 and 62 in the sheet width direction W in synchronization with the movement of the horizontal alignment plates 71 and 72 in the sheet width direction W. The interlocking mechanisms 80 are provided at the first horizontal alignment plate 71 side and at the second horizontal alignment plate 72 side, respectively. The interlocking mechanism 80 at the first horizontal alignment plate 71 side is described below. The interlocking mechanism 80 at the second horizontal alignment plate 72 side has the same constitution as that at the first horizontal alignment plate 71 side, and thus a detailed description thereof is omitted.

Figure 6:
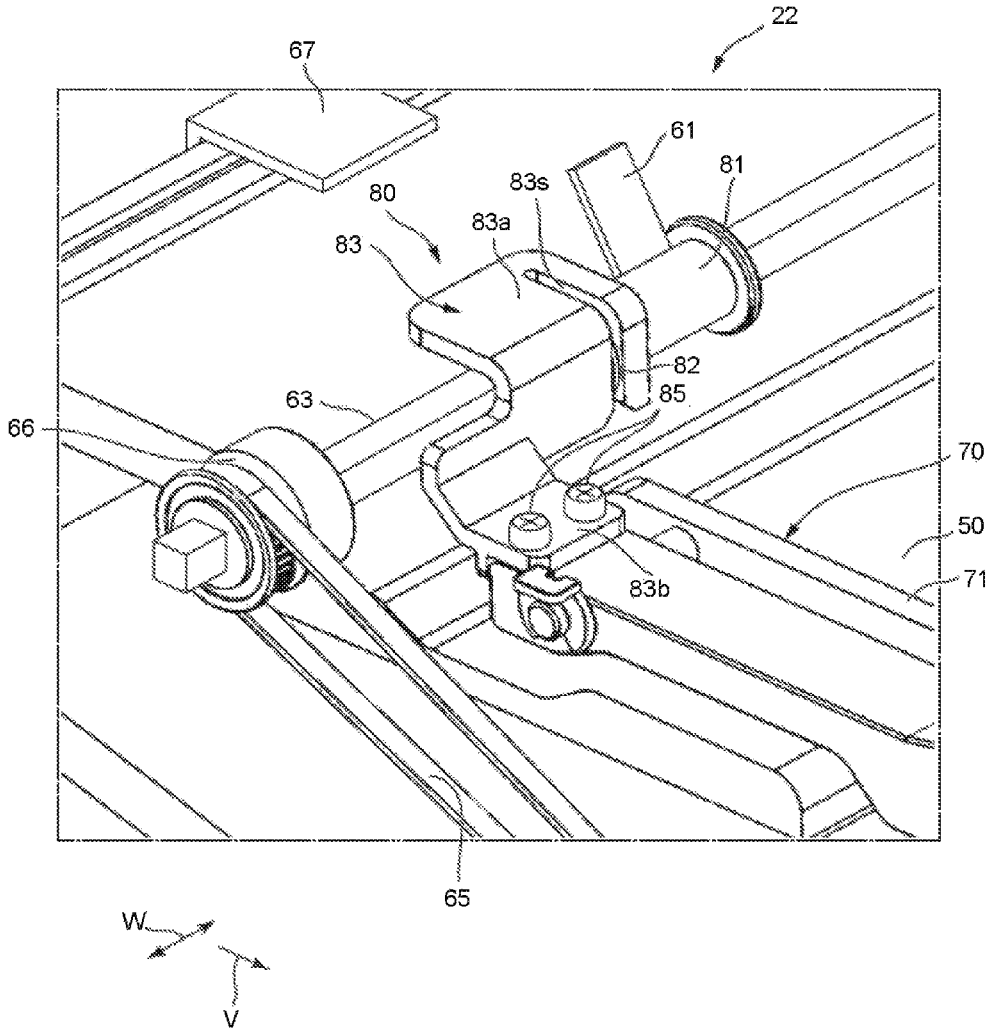
FIG. 6 is an enlarged perspective view illustrating the main portions of the processing section.
Figure 7:
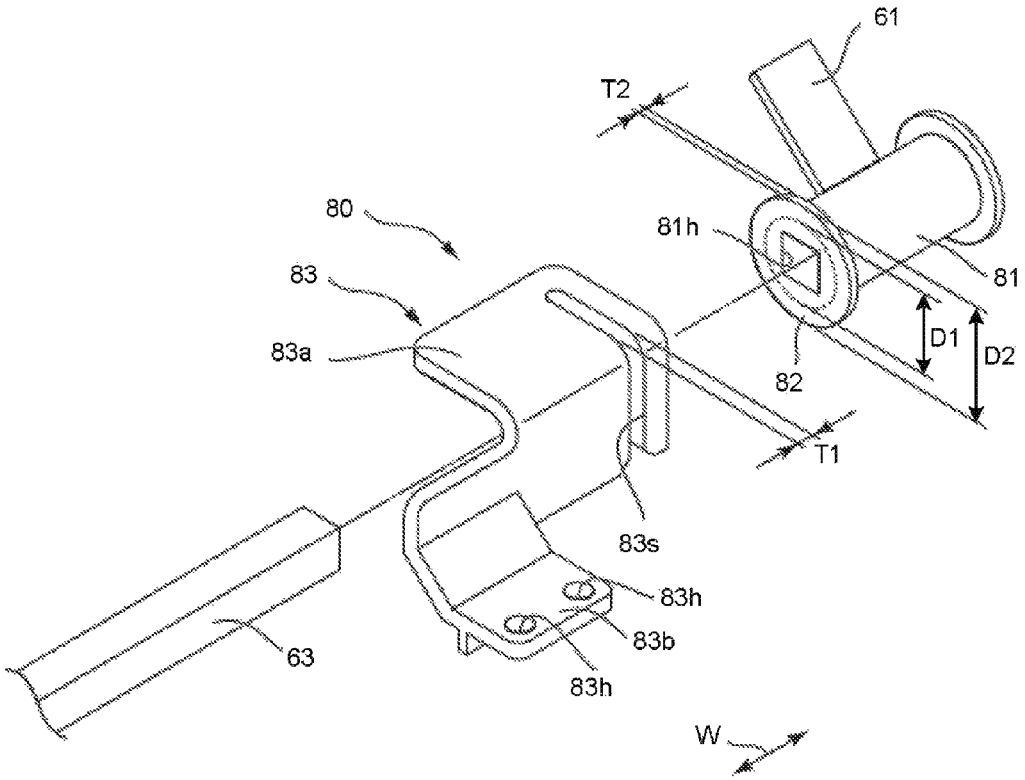
FIG. 7 is an exploded perspective view of an interlocking mechanism.

FIG. 6 is an enlarged perspective view of the main portions of the processing section 22 according to the embodiment. FIG. 7 is an exploded perspective view of the interlocking mechanism 80 according to the embodiment.

As shown in FIG. 6, the interlocking mechanism 80 includes the collar 81, a flange 82 and a bracket 83. The paddle 61 is attached to the collar 81. The collar 81 makes the paddle 61 and the shaft 63 non-rotatable with respect to each other around the shaft 63. In other words, the paddle 61 rotates integrally with the shaft 63 together with the collar 81. The collar 81 allows movement of the paddle 61 in the axial direction of the shaft 63. The paddle 61 is movable in the axial direction of the shaft 62 with respect to the shaft 63 together with the collar 81.

The shaft 63 has a prismatic shape. As shown in FIG. 7, the collar 81 is provided with a rectangular shaft insertion hole 81*h* if viewed from the axial direction of the shaft 63. The shaft 63 is inserted through the shaft insertion hole 81*h* of the collar 81. The collar 81 is slidably attached in the axial direction of the shaft 63 with respect to the shaft 63.

The flange 82 is provided at the end of the collar 81. The flange 82 forms an annular shape if viewed from the axial direction of the shaft 63. An outer peripheral surface of the collar 81 has a circular shape if viewed from the axial direction of the shaft 63. A diameter D2 of the flange 82 is larger than a diameter D1 of the collar 81 (D2>D1).

As shown in FIG. 6, the bracket 83 is connected to a support base of the horizontal alignment plate 71. The bracket 83 allows the rotation of the flange 82 about the shaft 63. The flange 82 is rotatable integrally with the shaft 63 together with the collar 81 and the paddle 61. The bracket 83 restricts the movement of the flange 82 in the axial direction of the shaft 63. The flange 82 is movable in the axial direction of the shaft 63 together with the collar 81 and the paddle 61 in synchronization with the movement of the bracket 83 in the sheet width direction W.

As shown in FIG. 7, the bracket 83 includes a flange regulating section 83*a* and a connection section 83*b*. The flange regulating section 83*a* and the connection section 83*b* are integrally formed with the same member. The flange regulating section 83*a* forms an L-shape opened at the shaft 63 side if viewed from the axial direction of the shaft 63. The flange regulating section 83*a* is provided with a slit 83*s* for avoiding the flange 82. As shown in FIG. 6, a part of the flange 82 is accommodated in the slit 83*s* of the flange regulating section 83*a*. As shown in FIG. 7, a width T1 of the slit 83*s* is larger than a thickness T2 of the flange 82 (T1>T2).

As shown in FIG. 6, the connection section 83*b* connects the flange regulating section 83*a* and the horizontal alignment plate 71. The connection section 83*b* extends from the end of the flange regulating section 83*a* towards the horizontal alignment plate 71. As shown in FIG. 7, the connection section 83*b* is provided with a plurality of through holes 83*h* through which bolts 85 (refer to FIG. 6) are inserted for attaching the connection section 83*b* to the horizontal alignment plate 71. In the embodiment, the connection section 83*b* is provided with two through holes 83*h* arranged at intervals in the sheet width direction W.

Next, the discharge section 23 is described.

As shown in FIG. 1, the discharge section 23 includes a fixed tray 23*a* and a movable tray 23*b*. The fixed tray 23*a* is provided at the upper side of the post-processing apparatus 3. The movable tray 23*b* is provided at the side of the post-processing apparatus 3. In the fixed tray 23*a* and the movable tray 23*b*, the sorted sheets S are discharged.

Next, the post-processing controller 24 is described.

Figure 8:
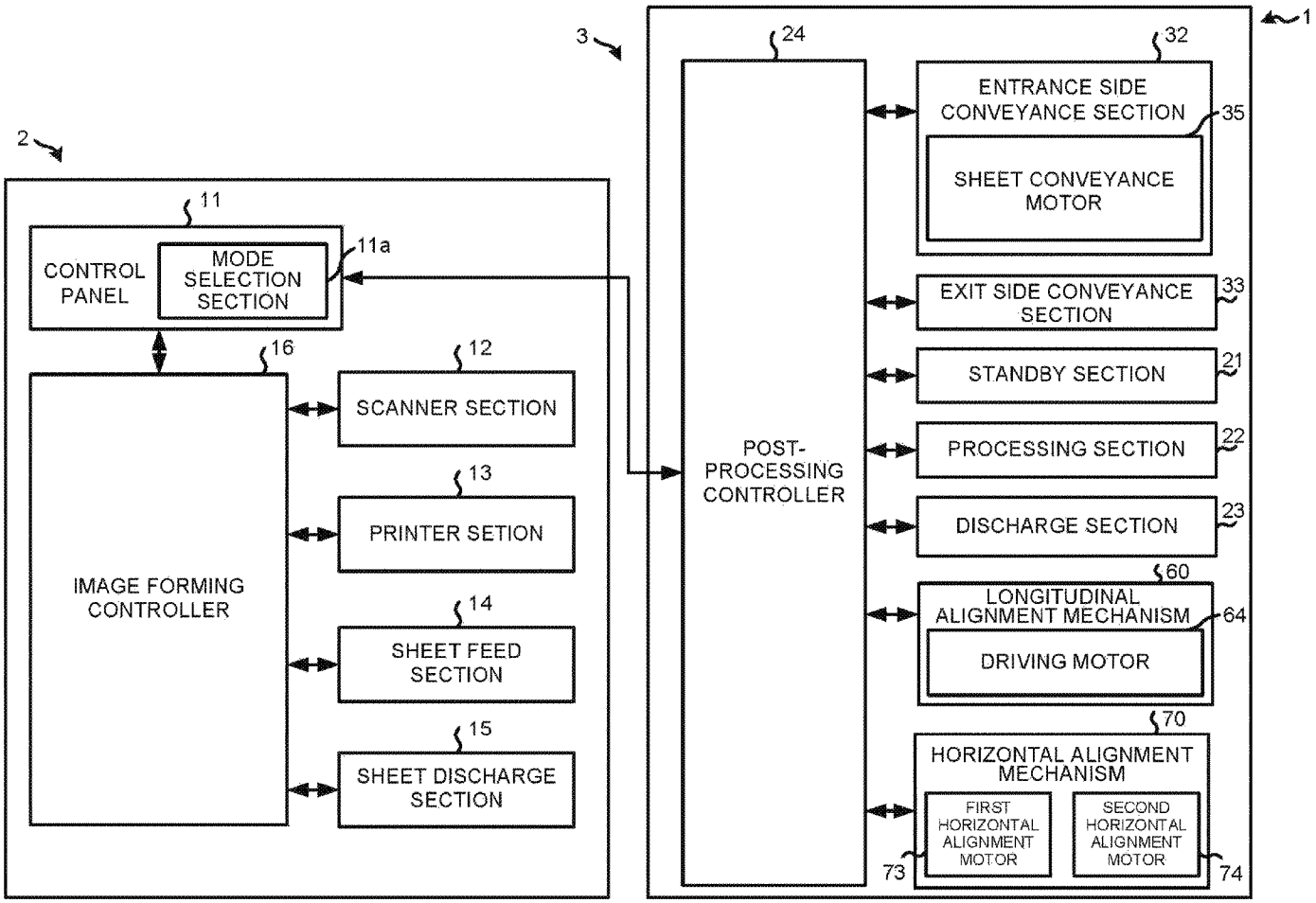
FIG. 8 is a block diagram illustrating an example of the image forming system.

FIG. 8 is a block diagram illustrating an example of the image forming system 1 according to the embodiment. As shown in FIG. 8, the post-processing controller 24 controls the overall operation of the post-processing apparatus 3. In other words, the post-processing controller 24 controls the entrance side conveyance section 32, the exit side conveyance section 33, the standby section 21, the processing section 22, the discharge section 23, the longitudinal alignment mechanism 60 and the horizontal alignment mechanism 70. The post-processing controller 24 is formed by a control circuit including a CPU, a ROM, and a RAM. The post-processing controller 24 is an example of a "control device".

For example, the post-processing controller 24 controls switching between a processing mode and a non-processing mode (normal mode). Here, the processing mode means a mode in which the post-processing is performed on the sheet S. For example, the processing mode includes a sorting mode and a stapling mode. The non-processing mode means a mode in which the sheet S is conveyed as it is without being subjected to the post-processing.

The control panel 11 includes a mode selection section 11*a* capable of selecting the processing mode and the non-processing mode. For example, the mode selection section 11*a* is a button provided on the control panel 11. If a user selects the "processing mode" at the time of mode selection and presses the button, the post-processing controller 24 executes the post-processing on the sheet S. On the other hand, if the user selects the "non-processing mode" at the time of mode selection and presses the button, the post-processing controller 24 does not execute the post-processing on the sheet S and discharges the sheet S without any change.

At the time of not conveying the sheet S, the post-processing controller 24 controls the sheet conveyance motor 35 in such a manner that the sheet conveyance motor 35 generates the driving power to rotate the paddles 61 and 62 (refer to FIG. 2). The post-processing controller 24 controls the sheet conveyance motor 35 in such a manner that the sheet conveyance motor 35 generates the driving power to rotate the paddles 61 and 62 if the sheet conveyance motor 35 does not drive the entrance rollers 32*a* and 32*b* (refer to FIG. 2). For example, if the entrance rollers 32*a* and 32*b* are not driven, the sheet conveyance motor 35, alone or in conjunction with the driving motor 64, rotates the paddles 61 and 62 (refer to FIG. 4).

Next, an example of the alignment operation of the sheet S in the embodiment is described.

As shown in FIG. 5, in the processing tray 50, the longitudinal alignment of the sheet S by the longitudinal alignment mechanism 60 and the horizontal alignment of the sheet S by the horizontal alignment mechanism 70 are performed. For example, before the sheet S is placed in the processing tray 50, the post-processing controller 24 controls at least one of the first horizontal alignment motor 73 and the second horizontal alignment motor 74 to separate the first horizontal alignment plate 71 and the second horizontal alignment plate 72 (refer to FIG. 8). A separation distance between the first horizontal alignment plate 71 and the second horizontal alignment plate 72 is wider than the width of the sheet S. Before the sheet S is placed on the processing tray 50, the post-processing controller 24 controls the driving motor 64 to rotate the paddles 61 and 62 to separate them from the upper surface of the sheet S placed on the processing tray 50. In other words, the driving motor 64 stops with the paddles 61 and 62 floating in the air without contacting with the upper surface of the sheet S.

After the sheet S is placed on the processing tray 50, the post-processing controller 24 controls at least one of the first horizontal alignment motor 73 and the second horizontal alignment motor 74 to bring the first horizontal alignment plate 71 and the second horizontal alignment plate 72 close to each other (refer to FIG. 8) in a state in which the paddles 61 and 62 are separated from the upper surface of the sheet S. Due to the approach between the first horizontal alignment plate 71 and the second horizontal alignment plate 72, the horizontal alignment mechanism 70 performs the horizontal alignment of the sheet S.

The paddles 61 and 62 are interlocked in the sheet width direction W in synchronization with the movement of the horizontal alignment plates 71 and 72 in the sheet width direction W by the operation of the interlocking mechanism 80. The paddles 61 and 62 move in the sheet width direction W in synchronization with the movement of the first horizontal alignment plate 71 and the second horizontal alignment plate 72.

After the sheet S is placed at a predetermined horizontal alignment position, the post-processing controller 24 controls the driving motor 64 to rotate the paddles 61 and 62 to convey the sheet S toward the stopper 67. By enabling the sheet S to contact with the stopper 67, the longitudinal alignment mechanism 60 performs the longitudinal alignment of the sheet S.

The post-processing controller 24 controls at least one of the first horizontal alignment motor 73 and the second horizontal alignment motor 74 after the sheet S is placed at a predetermined longitudinal alignment position to separate the first horizontal alignment plate 71 and the second horizontal alignment plate 72 to the original positions.

If the stapling mode is selected, the post-processing controller 24 controls the stapler 51 (refer to FIG. 2) and executes the stapling processing on a bundle including a plurality of the sheets S placed on the processing tray 50.

The operation of the interlocking mechanism 80 of the embodiment is described.

Figure 9:
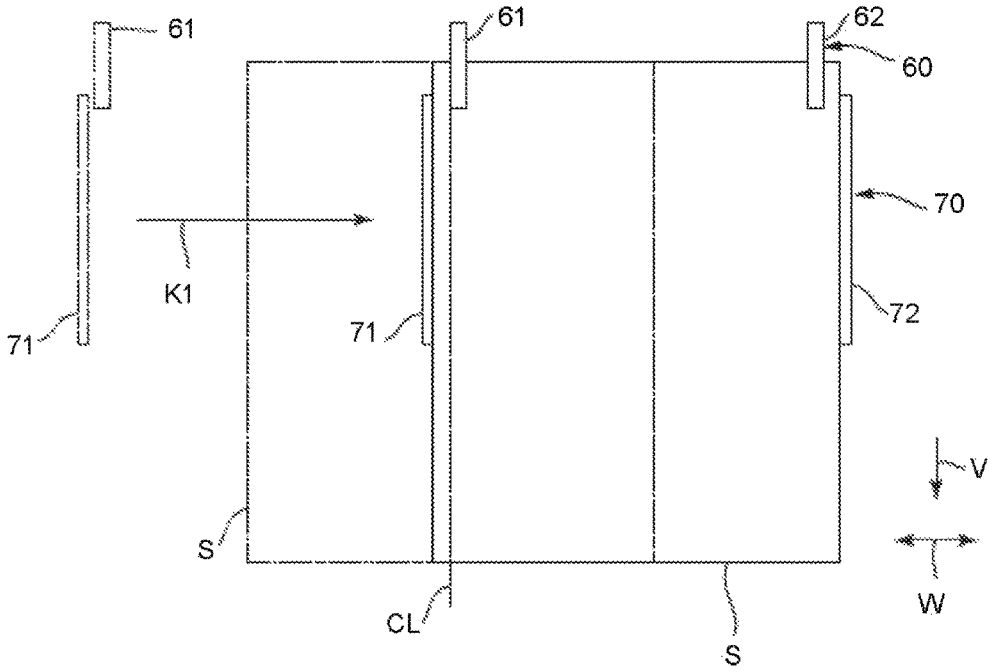
Figure 10:
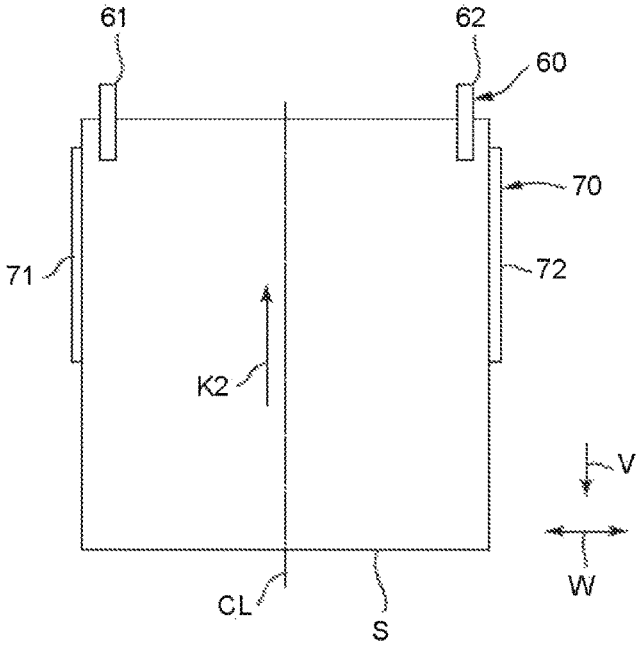
FIG. 10 is a view of the alignment operation of the sheet following FIG. 9.

FIG. 9 is a view illustrating an example of the alignment operation of the sheet S according to the embodiment. FIG. 10 is a view illustrating an example of the alignment operation of the sheet S following FIG. 9 according to the embodiment. In the following figures, a reference numeral CL indicates a center line of the sheet S in the sheet width direction W.

As shown in FIG. 9, the first horizontal alignment plate 71 moves in an arrow K1 direction in a state where the second horizontal alignment plate 72 is at a fixed position. Due to the approach between the first horizontal alignment plate 71 and the second horizontal alignment plate 72, the horizontal alignment mechanism 70 performs the horizontal alignment of the sheet S.

The paddle 61 is interlocked in the sheet width direction W in synchronism with the movement of the horizontal alignment plate 71 in the sheet width direction W by the operation of the interlocking mechanism 80 (refer to FIG. 4). The paddle 61 moves in the arrow K1 direction in synchronization with the movement of the first horizontal alignment plate 71.

As shown in FIG. 10, after the sheet S is placed at the predetermined horizontal alignment position, the paddles 61 and 62 are rotated to convey the sheet S towards a stopper (not shown). By enabling the sheet S to contact with the stopper, the longitudinal alignment mechanism 60 performs the longitudinal alignment of the sheet S.

After the horizontal alignment (position in FIG. 10), the positions of the paddles 61 and 62 in contact with the sheet S are not energized to one side with respect to the center of the sheet S but are arranged with good left-right balance. If the positions of the paddles 61 and 62 in contact with the sheet S are arranged with good left-right balance, the conveyance force of the paddles 61 and 62 has good left-right balance with respect to the center of the sheet S. The conveyance force (longitudinal alignment force) in an arrow K2 direction parallel to and opposite to the sheet conveyance direction V acts on the sheet S. Therefore, the skew of the sheet S can be suppressed.

By the way, in a constitution without the interlocking mechanism 80, if the sheet is moved in the sheet width direction by the horizontal alignment mechanism, or depending on the sheet size, the position or the number of paddles contacting with the sheet changes. If the position or number of paddles contacting with the sheet changes, the longitudinal alignment force changes as well. If the longitudinal alignment force changes, there is a possibility that the sheet skews and misalignment occurs. Hereinafter, the constitution without the interlocking mechanism 80 is referred to as a "comparative embodiment".

Figure 11:
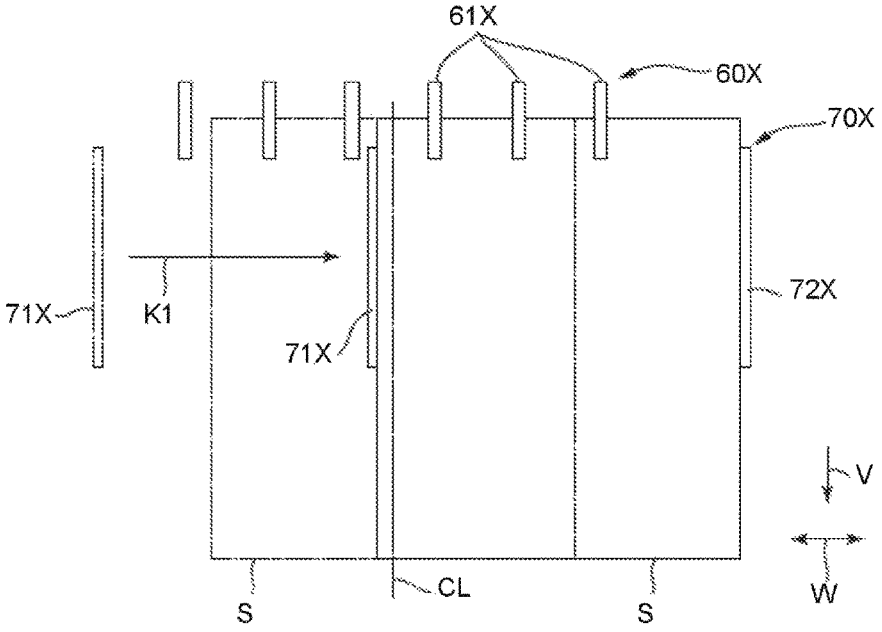
FIG. 11 is a view illustrating an alignment operation of a sheet according to a comparative embodiment.
Figure 12:
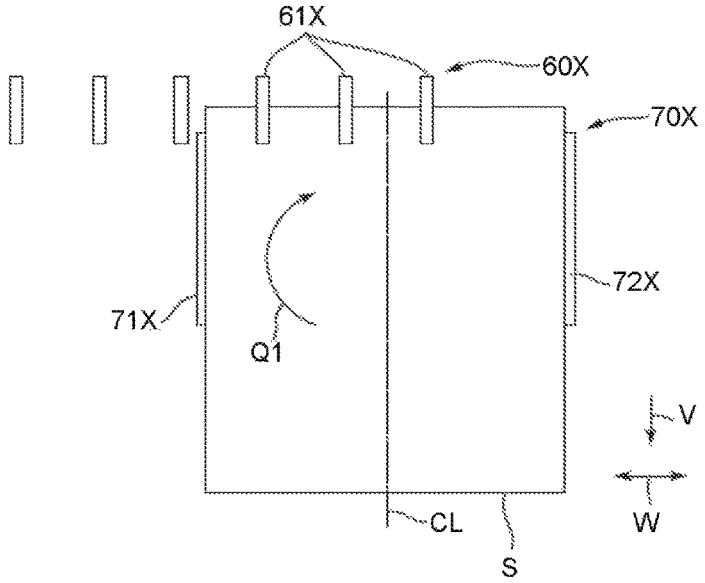
FIG. 12 is a view of the alignment operation of the sheet following FIG. 11.

FIG. 11 is a view illustrating the alignment operation of the sheet according to the comparative embodiment. FIG. 12 is a view illustrating the alignment operation of the sheet following FIG. 11 according to the comparative embodiment.

As shown in FIG. 11, the sheet processing apparatus of the comparative embodiment includes a longitudinal alignment mechanism 60X and a horizontal alignment mechanism 70X. The sheet processing apparatus of the comparative embodiment does not have the interlocking mechanism 80 in the embodiment. In the comparative embodiment, the longitudinal alignment mechanism 60X includes a plurality of paddles 61X. In the comparative embodiment, the longitudinal alignment mechanism 60X includes six paddles 61X. The six paddles 61X are attached to a shaft (not shown). In the comparative embodiment, the horizontal alignment mechanism 70X includes a first horizontal alignment plate 71X and a second horizontal alignment plate 72X.

As shown in FIG. 11, the first horizontal alignment plate 71X moves in the arrow K1 direction in a state where the second horizontal alignment plate 72X is at a fixed position. Due to the approach of the first horizontal alignment plate 71X and the second horizontal alignment plate 72X, the horizontal alignment mechanism 70X performs the horizontal alignment of the sheet S.

In the comparative embodiment, since the interlocking mechanism 80 is not provided, the paddle 61X is stopped at a fixed position (initial position). In the comparative embodiment, even if the first horizontal alignment plate 71X moves, the paddle 61X does not move and remains at the fixed position.

As shown in FIG. 12, after the sheet S is placed at the predetermined horizontal alignment position, the paddle 61X rotates to convey the sheet S toward a stopper (not shown). By enabling the sheet S to contact with the stopper, the longitudinal alignment mechanism 60X performs the longitudinal alignment of the sheet S. However, in the comparative embodiment, the position or the number of the paddles 61X contacting with the sheet S changes. After the horizontal alignment (the position of FIG. 12), the position of the paddle 61X that contacts with the sheet S is biased to one side (the left side of the paper surface) with respect to the center of the sheet S, resulting in imbalance between the left and the right. If the position of the paddle 61X in contact with the sheet S is biased toward one side with respect to the center of the sheet, the conveyance force of the paddle 61X is biased to one side with respect to the center of the sheet S. If the conveyance force of the paddle 61X is biased toward one side with respect to the center of the sheet S, the sheet S skews in an arrow Q1 direction and misalignment occurs.

According to the embodiment, the post-processing apparatus 3 has the processing tray 50, the longitudinal alignment mechanism 60, the horizontal alignment mechanism 70, and the interlocking mechanism 80. The processing tray 50 can stack the sheet S. The longitudinal alignment mechanism 60 includes rotatable paddles 61 and 62. The longitudinal alignment mechanism 60 can align the sheet S stacked on the processing tray 50 in the sheet conveyance direction V. The horizontal alignment mechanism 70 has the horizontal alignment plates 71 and 72 movable in the sheet width direction W. The horizontal alignment mechanism 70 can align the sheet S stacked on the processing tray 50 in the sheet width direction W. The interlocking mechanism 80 interlocks the paddles 61 and 62 in the sheet width direction W in synchronization with the movement of the horizontal alignment plates 71 and 72 in the sheet width direction W. With the above constitution, the following effects are achieved. In a case of moving the sheet S in the sheet width direction W by the horizontal alignment mechanism 70, the paddles 61 and 62 are interlocked in the sheet width direction W synchronously with the movement of the horizontal alignment plates 71 and 72 in the sheet width direction W, and thus, it is possible to suppress the change in the longitudinal alignment force. Therefore, it is possible to suppress the sheet S from skewing and to suppress the misalignment. In addition, regardless of the sheet size, the skew of the sheet S can be suppressed and the misalignment can be suppressed. If the stapling mode is selected, the stapling processing can be executed at a precise position on the bundle including a plurality of the sheets S. Since it is unnecessary to dispose many paddles in the axial direction of the shaft 63 to correspond to the sheet size and offset position, it is possible to reduce the cost of the longitudinal alignment mechanism 60.

The horizontal alignment mechanism 70 includes the first horizontal alignment plate 71 and the second horizontal alignment plate 72 separated from each other in the sheet width direction W. The longitudinal alignment mechanism 60 includes the first paddle 61 and the second paddle 62 formed of an elastic material. The first paddle 61 is positioned at the second horizontal alignment plate 72 side by the first distance L1 from the first horizontal alignment plate 71. The second paddle 62 is positioned at the first horizontal alignment plate 71 side by the second distance L2 of the same length as the first distance L1 from the second horizontal alignment plate 72. With the above constitution, the following effects are achieved. Regardless of the sheet size, it is possible to strike a certain position with the paddle from the horizontal alignment plates 71 and 72. The positions of the paddles 61 and 62 in contact with the sheet S are arranged with good left-right balance without being biased toward one side with respect to the center of the sheet S. Therefore, the conveyance force of the paddles 61 and 62 has the good left-right balance with respect to the center of the sheet S, and thus, the sheet S can be prevented from skewing and the misalignment can be suppressed.

The longitudinal alignment mechanism 60 includes the shaft 63, the driving motor 64 and the belt 65. The shaft 63 extends in the sheet width direction W. The driving motor 64 generates the driving power to rotate the paddles 61 and 62 about the shaft 63. The belt 65 is stretched over the shank of the driving motor 64 and the shaft 63. With the above constitution, the following effects are achieved. The longitudinal alignment mechanism 60 can be simplified and the cost can be reduced as compared with the case in which a plurality of gears and the like are provided between the shank of the driving motor 64 and the shaft 63.

The interlocking mechanism 80 includes the collar 81, the flange 82, and the bracket 83. The paddle is attached to the collar 81. The collar 81 makes the paddles 61 and 62 and the shaft 63 non-rotatable with respect to each other about the shaft 63. The collar 81 allows the movement of the paddles 61 and 62 in the axial direction of the shaft 63. The flange 82 is provided on the collar 81. The bracket 83 is connected to the horizontal alignment plates 71 and 72. The bracket 83 allows rotation of the flange 82 about the shaft 63. The bracket 83 restricts the movement of the flange 82 in the axial direction of the shaft 63. With the above constitution, the following effects are achieved. As compared with a case in which a driving mechanism including a motor for interlocking the paddles 61 and 62 in the sheet width direction W is provided in synchronization with the movement of the horizontal alignment plates 71 and 72 in the sheet width direction W, the apparatus constitution can be simplified and the cost can be reduced.

The bracket 83 has the following effects by providing the slit 83*s* for avoiding the flange 82. It is possible to realize the permission of the rotation of the flange 82 about the shaft 63 and the restriction of the movement of the flange 82 in the axial direction of the shaft 63 with a simple constitution.

The shaft 63 has a prismatic shape. The collar 81 is provided with the rectangular shaft insertion hole 81*h* if viewed from the axial direction of the shaft 63. With the above constitution, the following effects are achieved. It is possible to make the paddles 61 and 62 the shaft 63 non-rotatable with respect to each other around the shaft 63 and realize the permission of the movement of the paddles 61 and 62 in the axial direction of the shaft 63 with a simple constitution.

The first paddle 61 and the second paddle 62 have the same shape. The first paddle 61 and the second paddle 62 have the same elastic force with respect to each other. With the above constitution, the following effects are achieved. Since the first paddle 61 and the second paddle 62 can be formed as the common paddles, the number of components can be reduced and the cost can be reduced as compared with the case of using different paddles.

The longitudinal alignment mechanism 60 has the following effects by providing the common driving motor 64 which generates the driving power to rotate the first paddle 61 and the second paddle 62. The number of components can be reduced and the cost can be reduced as compared with the case of providing respective driving motors for the first paddle 61 and the second paddle 62. In addition, it is preferable if it is not necessary to synchronize the drive control of the first paddle 61 with the drive control of the second paddle 62.

The post-processing apparatus includes the sheet conveyance motor 35 and the post-processing controller 24. The sheet conveyance motor 35 generates the driving power to convey the sheet S. In a case of not conveying the sheet S, the post-processing controller 24 controls the sheet conveyance motor 35 in such a manner that the sheet conveyance motor 35 generates the driving power to rotate the paddles 61 and 62. With the above constitution, the following effects are achieved. The driving power of the sheet conveyance motor 35 can be utilized for the rotation driving power of the paddles 61 and 62. For example, it is preferable if it is not necessary to drive the sheet conveyance motor 35 until the next sheet S comes.

A modification is described below.

The second paddle 62 is not limited to being positioned at the first horizontal alignment plate 71 side by the second distance L2 as long as the first distance L1 from the second horizontal alignment plate 72. For example, the second paddle 62 may be positioned at the first horizontal alignment plate 71 side by the second distance L2 of a length different from the first distance L1 from the second horizontal alignment plate 72. According to the present modification, different positions are struck from the horizontal alignment plates 71 and 72 with the paddles 61 and 62. However, by making the elastic force of the paddles 61 and 62 different from each other and making the force of striking the sheet S different, it is possible to suppress the sheet S from skewing and the misalignment can be suppressed.

The belt 65 is not limited to being stretched over the shank of the driving motor 64 and the shaft 63. For example, a plurality of gears or the like may be provided between the shank of the driving motor 64 and the shaft 63. A power transmission portion may be provided between the shank of the driving motor 64 and the shaft 63.

The bracket 83 is not limited to providing the slit 83*s* for avoiding the flange 82. For example, the bracket 83 may be provided with a pair of walls rotatably sandwiching the flange 82 in the axial direction of the shaft 63. In other words, the bracket 83 may have any structure as long as it allows the rotation of the flange 82 around the shaft 63 and regulates the movement of the flange 82 in the axial direction of the shaft 63.

The shaft 63 is not limited to having the prismatic shape. For example, the shaft 63 may have a D-shaped cross-sectional shape. In a case in which the shaft 63 has the D-shaped cross-sectional shape, the shaft insertion hole 81*h* of the collar 81 has the D shape if viewed from the axial direction of the shaft 63. The collar 81 may have any structure as long as it makes the paddle and the shaft 63 non-rotatable with respect to each other around the shaft 63, and allows the paddle to move in the axial direction of the shaft 63.

The first paddle 61 and the second paddle 62 are not limited to having the same shape. For example, the first paddle 61 and the second paddle 62 may have different shapes from each other.

The first paddle 61 and the second paddle 62 are not limited to having the same elastic force with respect to each other. For example, the first paddle 61 and the second paddle 62 may have mutually different elastic forces.

The longitudinal alignment mechanism 60 is not limited to having the common driving motor 64 that generates the driving power to rotate the first paddle 61 and the second paddle 62. For example, the driving motor for the first paddle 61 and the driving motor for the second paddle 62 may be arranged, respectively.

The present invention is not limited to including only one paddle 61 or one paddle 62 on the collar 81. For example, a plurality of paddles may be provided in the collar 81.

The present invention is not limited to arranging only two collars 81 on the shaft 63. For example, three or more collars 81 may be provided on the shaft 63.

According to at least one embodiment described above, the post-processing apparatus 3 has the processing tray 50, the longitudinal alignment mechanism 60, the horizontal alignment mechanism 70, and the interlocking mechanism 80. The processing tray 50 can stack the sheet S. The longitudinal alignment mechanism 60 includes rotatable paddles 61 and 62. The longitudinal alignment mechanism 60 can align the sheet S stacked on the processing tray 50 in the sheet conveyance direction V. The horizontal alignment mechanism 70 has the horizontal alignment plates 71 and 72 movable in the sheet width direction W. The horizontal alignment mechanism 70 can align the sheet S stacked on the processing tray 50 in the sheet width direction W. The interlocking mechanism 80 interlocks the paddles 61 and 62 in the sheet width direction W in synchronization with the movement of the horizontal alignment plates 71 and 72 in the sheet width direction W. With the above constitution, the following effects are achieved. In a case of moving the sheet S in the sheet width direction W by the horizontal alignment mechanism 70, the paddles 61 and 62 are interlocked in the sheet width direction W synchronously with the movement of the horizontal alignment plates 71 and 72 in the sheet width direction W, and thus, it is possible to suppress the change in the longitudinal alignment force. Therefore, it is possible to suppress the sheet S from skewing and to suppress the misalignment. In addition, regardless of the sheet size, the skew of the sheet S can be suppressed and the misalignment can be suppressed. If the stapling mode is selected, the stapling processing can be executed at a precise position on the bundle including a plurality of the sheets S. Since it is unnecessary to dispose many paddles in the axial direction of the shaft 63 to correspond to the sheet size and offset position, it is possible to reduce the cost of the longitudinal alignment mechanism 60.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing apparatus, comprising:

a processing tray to stack a sheet;

a longitudinal alignment mechanism having a rotatable paddle to align the sheets stacked on the processing tray in a sheet conveyance direction;

a horizontal alignment mechanism having a horizontal alignment plate movable in a sheet width direction orthogonal to the sheet conveyance direction, which align the sheets stacked on the processing tray in the sheet width direction; and an interlocking mechanism configured to interlock the paddle in the sheet width direction in accordance with movement of the horizontal alignment plate in the sheet width direction.

2. The sheet processing apparatus according to claim 1, wherein the horizontal alignment mechanism includes a plurality of the horizontal alignment plates, the plurality of the horizontal alignment plates include a first horizontal alignment plate and a second horizontal alignment plate that are separated from each other in the sheet width direction, the longitudinal alignment mechanism includes a plurality of the paddles each formed by an elastic material, and the plurality of paddles includes a first paddle positioned at the second horizontal alignment plate side by a first distance from the first horizontal alignment plate and a second paddle positioned at the first horizontal alignment plate side by a second distance as long as the first distance from the second horizontal alignment plate.

3. The sheet processing apparatus according to claim 1, wherein the longitudinal alignment mechanism further includes a shaft extending in the sheet width direction and a driving motor generating driving power to rotate the paddle about the shaft.

4. The sheet processing apparatus according to claim 3, wherein the longitudinal alignment mechanism further includes a belt stretched over a shank of the driving motor and the shaft.

5. The sheet processing apparatus according to claim 3, wherein the interlocking mechanism includes a collar to which the paddle is attached and which makes the paddle and the shaft non-rotatable with respect to each other about the shaft and allows movement of the paddle in an axial direction of the shaft, a flange arranged on the collar, and a bracket connected to the horizontal alignment plate to allow rotation of the flange around the shaft and restrict movement of the flange in the axial direction of the shaft.

6. The sheet processing apparatus according to claim 5, wherein the bracket is provided with a slit for avoiding the flange.

7. The sheet processing apparatus according to claim 5, wherein the shaft has a prismatic shape, and the collar is provided with a rectangular shaft insertion hole if viewed from the axial direction of the shaft.

8. The sheet processing apparatus according to claim 2, wherein the first paddle and the second paddle mutually have the same shape and the same elastic force.

9. The sheet processing apparatus according to claim 2, wherein the longitudinal alignment mechanism further includes a common driving motor that generates driving power to rotate the first paddle and the second paddle.

10. The sheet processing apparatus according to claim 1, further comprising:

a sheet conveyance motor configured to generate driving power to convey the sheet; and a controller configured to control the sheet conveyance motor in such a manner the sheet conveyance motor generates the driving power to rotate the paddle if the sheet is not conveyed.

* * * * *